United States Patent [19]

Yang

[11] Patent Number: 4,854,910

[45] Date of Patent: Aug. 8, 1989

[54] SHOOTING TOY

[76] Inventor: Yug L. Yang, No. 590, Chien Kang 3rd. Street, Tainan, Taiwan

[21] Appl. No.: 217,896

[22] Filed: Jul. 12, 1988

[51] Int. Cl.[4] ..... A63H 33/04; A63H 33/30; A63H 3/54; F41J 1/16

[52] U.S. Cl. ..... 446/177; 446/92; 446/473; 446/476; 273/393

[58] Field of Search ..... 446/177, 92, 176, 178, 446/180, 183, 184, 185, 199, 198, 197, 236, 473, 476, 477; 273/393, 368

[56] References Cited

U.S. PATENT DOCUMENTS

| | | | |
|---|---|---|---|
| 3,346,989 | 10/1967 | Ryan et al. | 446/198 X |
| 3,503,152 | 3/1970 | Aoki et al. | 446/199 X |
| 3,734,503 | 5/1973 | Breslow | 273/393 |
| 3,811,675 | 5/1974 | Torgow | 273/357 |
| 3,817,528 | 6/1974 | Stuhler | 273/393 |
| 4,236,345 | 12/1980 | Inoue | 446/197 |
| 4,250,656 | 2/1981 | Barlow et al. | 446/180 |
| 4,388,776 | 6/1983 | Spring | 446/197 |
| 4,583,957 | 4/1986 | Levy | 446/177 |

FOREIGN PATENT DOCUMENTS

| | | | |
|---|---|---|---|
| 7623562 | 8/1976 | France | 273/368 |

*Primary Examiner*—Robert A. Hafer
*Assistant Examiner*—D. Neal Muir
*Attorney, Agent, or Firm*—Lowe, Price, LeBlanc, Becker & Shur

[57] ABSTRACT

This invention relates to a shooting toy and, in particular, to one including a base plate, two imitation figures, two guns and several pictures. When the imitation figures are pressed down to the end of a respective hollow barrel, air will be pressed into the guns through a pneumatic pipe and push a suction cup out to suck a picture out from an outer rotating shell to enjoy shooting fun.

2 Claims, 6 Drawing Sheets

SHOOTING TOY

BACKGROUND OF THE INVENTION

Numerous toy factories, for example in Taiwan, disappeared from the market last year owing to the rising rate of NT Dollars. Some of them have closed their production lines and some have announced bankruptcy. It is obvious that the situation will very likely become even worse.

The inventor of this invention, therefore, has invented this shooting toy which is believed to be enjoyable, inexpensive and very attractive to children.

SUMMARY OF THE INVENTION

It is the primary object of the present invention to provide a shooting toy which is attractive to children;

It is another object of the present invention to provide a shooting toy which is inexpensive to produce;

It is a further object of the present invention to provide a shooting toy which is easy to produce.

The present invention will be more fully understood and appreciated from the following detailed description taken in conjunction with the following drawings.

DETAILED DESCRIPTION OF A PREFERRED EMBODIMENT

Figure 1:
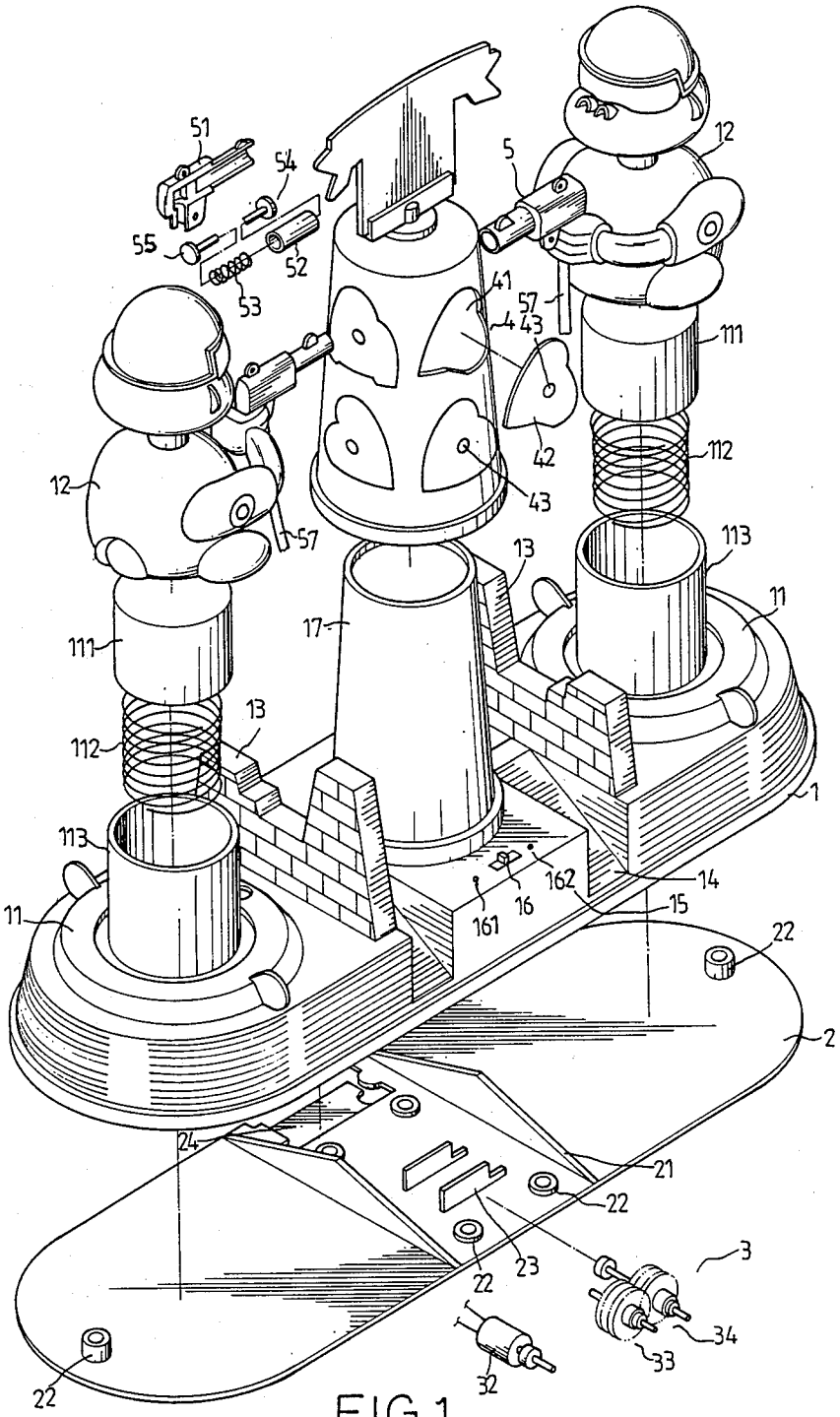
FIG. 1 is an exploded view of a shooting toy constructed according to a preferred embodiment of the present invention.

Reference is now made to FIG. 1. The shooting toy illustrated therein comprises a base plate 1, two imitation FIGS. 12, two guns 5, an outer rotating shell 4, several pictures 42 and a transmission device 3 (illustrated in part by broken lines). The base plate 1 has a platform 15 at middle position, with two slant troughs 14, one each on either side of the platform 15. Two round plates 11 and two walls 13 are disposed as shown on opposite sides of the platform 15.

Each of the two imitation FIGS. 12 holds a gun 5 with its arms and sits on a stand 111 which is placed on a helical spring 112. Pressing down of the imitation FIG. 12 on its stand 111 will compress the helical spring 112 thereunder down into a hollow barrel 113 in the upper one third inside of the hollow barrel 113 and leave the other two thirds space of the hollow barrel 113 to accommodate the compressed ring spring 112

Figure 8:
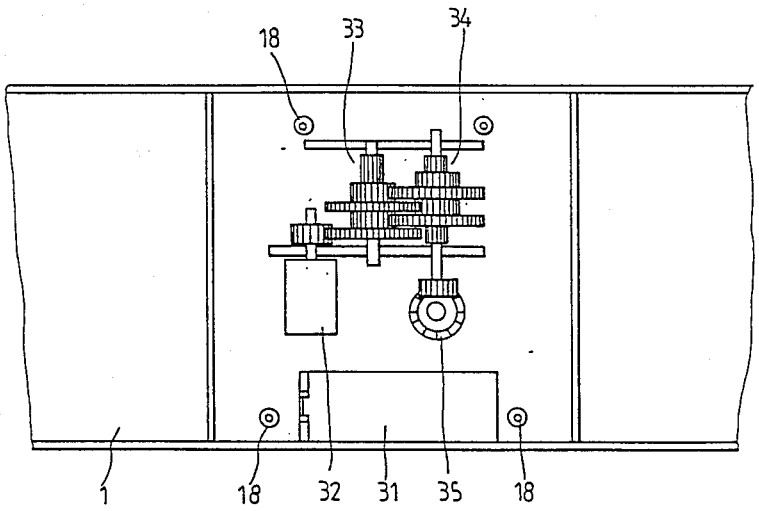
FIG. 8 is a plan view of the transmission device constructed in accordance with the present invention.

A separate pneumatic tube 56, best seen in FIGS. 3–6, having one end connected to the bottom of the round plate 11 is connected at its other end to each gun 5. Each of the guns 5, as best seen in FIG. 1, has a casing 51, a barrel 52, a spring 53, a suction cup 54 and firing pin 55. The outer rotating shell 4 (see FIG. 2) has several troughs 41 for accommodating respective ones of pictures 42 and covers an inner rotating shell 17. A transmission device 3 (see FIGS. 1 and 8) includes a battery 31, a motor 32, an inner gear 33, an outer gear 34 and a crown gear 35. This transmission device is placed under the base plate 1 and on a foundation plate 2.

Figure 2:
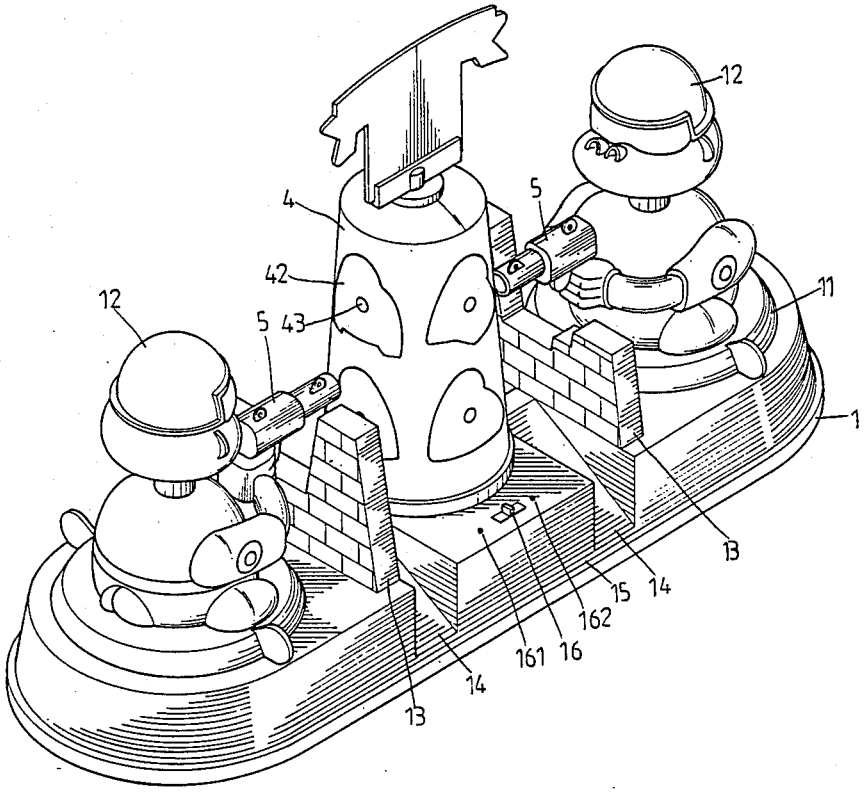
FIG. 2 shows a front perspective view of a shooting toy constructed in accordance with the present invention.

FIG. 2 is the perspective view of an assembled toy constructed in accordance with the present invention.

Figure 3:
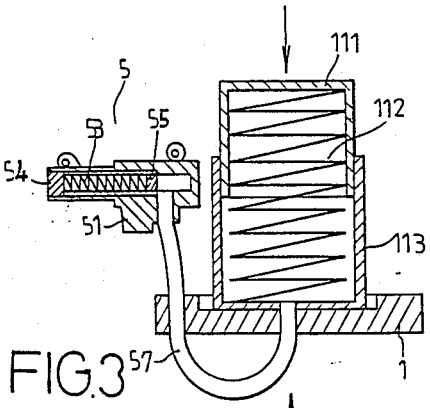
FIG. 3, 4, 5 and 6 are vertical cross-sectional view of portions of the present invention.

With reference now to FIG. 3 the stand 11 is seen disposed in the top one third of the hollow barrel 113 and the remaining two thirds of the space in the hollow barrel 113 is filled with the ring spring 112.

Figure 4:
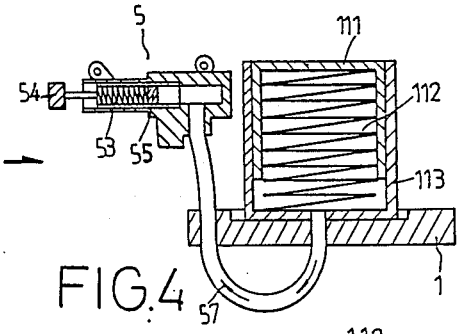

FIG. 4 shows the stand 111 pushed down into barrel 113, at which time, air will be passed through pneumatic tube 57 into the gun 5. This air 10 will push the firing pin 55 forward which then presses the spring 53 forward and pushes the suction cup 54 on a rod projecting outwardly of the gun 5.

Figure 5:
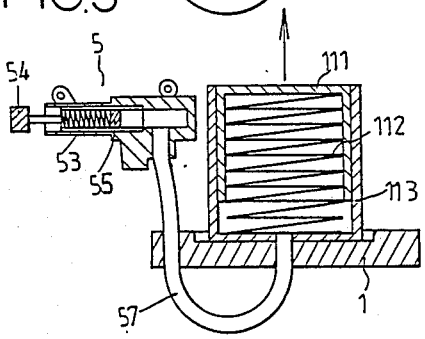
Figure 6:
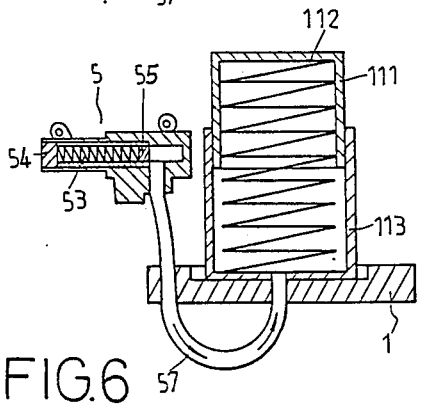

FIG. 5 and 6 illustrate a reverse movement. FIG. 5 has the suction cup 54 on the rod stretched out because of the air pressure from the pneumatic tube 57. However, when the pressing force from the stand 111 is removed as indicated in FIG. 6, the ring spring 112, because of its elastic force, will push the stand 111 upward and this causes air to be returned to the hollow barrel 113, and suction cup 54 retreats to its original 20 position into the barrel 52 of the gun 5.

Figure 7:
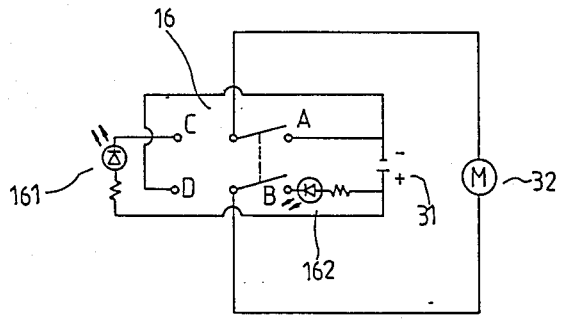
FIG. 7 is a schematic diagram of the circuitry of the present invention.

Reference to FIG. 7 discloses a schematic diagram of the circuitry of the present invention. When switch 16 is turned to the right position, a signal will be transmitted from the positive terminal of the battery 31 to LED1 161 which will then be illuminated and a current will keep on flowing to drive the motor 32 (shown in FIG. 8) then through the points B to D to C then to A (best seen in FIG. 7) and return to the negative terminal of the battery 31. This current to the motor 32 will drive the motor to actuate the inner gear 33, the outer gear 34 and the idle gear 35. The idle gear 35, upon being driven, will actuate the inner rotating shell 17 and the outer rotating shell 4 to rotate them clockwisely. Should the switch 16 be turned to the left position, the current, as can be seen from FIG. 7, will illuminate LED2 162 and drive the motor 32 which will actuate the inner gear 33, the outer gear 34 and the idle gear 35. The idle gear 35, at this moment, will drive the inner rotating shell 17 and the outer rotating shell 4 to rotate counterclockwisely.

Figure 9:
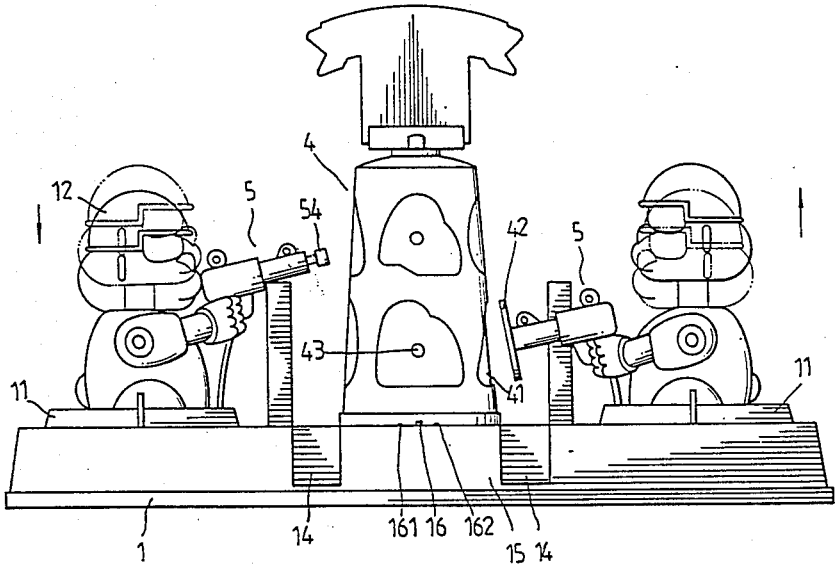
FIG. 9 is a side elevation view of the present invention.

FIG. 9 is a side elevation view of the present invention. As seen therein, upon pressing either of the FIGS. 12 downward, air will pass through the pneumatic tube 57 into the corresponding one of the guns 5 and will push the firing pin 55 forward which, then, will push the spring 53 forward and force the suction cup 54 in stretched out manner to suck a picture 42 out from the outer rotating shell 4. Upon the pressing force on the imitating FIGS. 12 being removed, the elastic force of the corresponding ring spring 112 will force the stand upward to its original position in the upper one third of the hollow barrel 113, air will flow back into the hollow barrel 113 and the suction cup 54 will be retreated into the barrel 52, whereupon the sucked out picture 42 falls down and the user will have accomplished the shooting mission.

I claim:

1. A shooting toy, comprising:

a base plate, having two round plates disposed on opposite sides of a central platform, two walls also disposed on opposite sides of the platform, an inner rotatable shell, two slant troughs one on each side of the platform, a switch and two LEDs, wherein said round plates have thereon corresponding barrels for each accommodating one of two figures each of which has a stand supported on a helical spring;

a transmission device, having a battery, a motor, an inner gear, an outer gear and an idle gear, said motor, inner gear, outer gear and idle gear all being rotatable supported on a foundation plate and covered with said base plate;

an outer rotating shell having several troughs therein for accommodating pictures, the outer shell covering the inner rotating shell;

two guns, each having a casing, a barrel, a spring, a suction cup, a firing pin and a pneumatic tube, wherein each said pneumatic tube has one end connected to one of said round plates and another end connected to a corresponding one of said guns, whereby a downward force on the head of either of the two figures into the the hollow barrel enables the suction cup to be moved forward and to contact and apply suction to a picture to remove the picture out of the trough holding the same on the outer rotating shell.

2. A shooting toy as claimed in claim 1, further comprising:

a switch and two LEDs, connected such that when said switch is turned to a first position, a first one of the two LEDs is illuminated and said motor is actuated to drive said inner gear, outer gear and idle gear to thereby rotate said inner rotating shell and outer rotating shell to rotate clockwise and when the switch is turned to a second position a second one of the two LEDs is illuminated and said motor rotates said inner rotating shell and outer rotating shell counterclockwise.

* * * * *